US005671718A

United States Patent [19]

Curran et al.

[11] Patent Number: 5,671,718

[45] Date of Patent: Sep. 30, 1997

[54] METHOD AND SYSTEM FOR CONTROLLING A FLOW OF VAPOR IN AN EVAPORATIVE SYSTEM

[75] Inventors: Patrick Joseph Curran, Farmington Hills; Robert Joseph Pace, Wyandotte; Edward George Rychlick, Dearborn; David Chester Waskiewicz, Novi, all of Mich.

[73] Assignee: Ford Global Technologies, Inc., Dearborn, Mich.

[21] Appl. No.: 546,626

[22] Filed: Oct. 23, 1995

[51] Int. Cl.[6] ..... F02M 37/04

[52] U.S. Cl. ..... 123/520; 123/357

[58] Field of Search ..... 123/520, 519, 123/516, 518, 521, 198 D, 357

[56] References Cited

U.S. PATENT DOCUMENTS

| | | | |
|---|---|---|---|
| 5,261,379 | 11/1993 | Lipinski et al. | 123/520 |
| 5,333,589 | 8/1994 | Otsuka | 123/198 D |
| 5,353,771 | 10/1994 | Blumenstock | 123/198 D |
| 5,355,864 | 10/1994 | Kuroda | 123/198 D |
| 5,398,662 | 3/1995 | Igarashi | 123/198 D |
| 5,463,998 | 11/1995 | Denz | 123/198 D |
| 5,501,198 | 3/1996 | Koyama | 123/198 D |
| 5,524,595 | 6/1996 | Ito | 123/520 |

*Primary Examiner*—Carl S. Miller

*Attorney, Agent, or Firm*—Peter Abolins; Roger L. May

[57] ABSTRACT

A method and system for determining a level of vapor generated by an evaporative system. The evaporative system is closed to atmosphere. An initial pressure in a fluid-filled tank is sensed and, after a predetermined amount of time, a second pressure in the tank is sensed. A pressure difference is determined based on the sensed initial pressure and the sensed second pressure. The level of vapor generated by the evaporative system is determined based on the pressure difference.

20 Claims, 6 Drawing Sheets

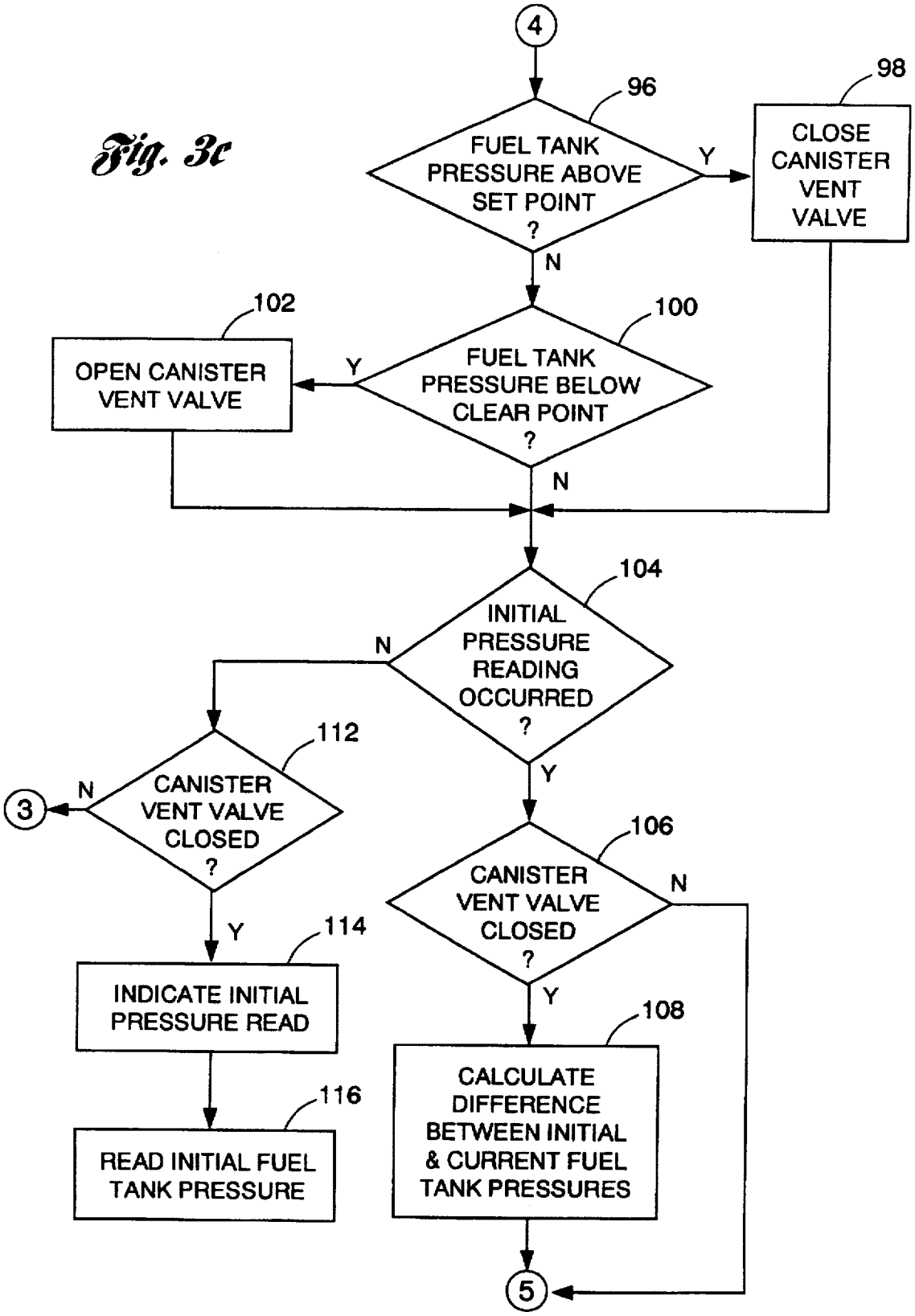
Fig. 3c
4
96
FUEL TANK PRESSURE ABOVE SET POINT ?
Y
98
CLOSE CANISTER VENT VALVE
N
102
OPEN CANISTER VENT VALVE
Y
100
FUEL TANK PRESSURE BELOW CLEAR POINT ?
N
104
INITIAL PRESSURE READING OCCURRED ?
N
112
CANISTER VENT VALVE CLOSED ?
N
3
Y
114
INDICATE INITIAL PRESSURE READ
116
READ INITIAL FUEL TANK PRESSURE
Y
106
CANISTER VENT VALVE CLOSED ?
N
Y
108
CALCULATE DIFFERENCE BETWEEN INITIAL & CURRENT FUEL TANK PRESSURES
5

METHOD AND SYSTEM FOR CONTROLLING A FLOW OF VAPOR IN AN EVAPORATIVE SYSTEM

TECHNICAL FIELD

This invention relates to a method and system for determining a level of vapor in an evaporative system of an internal combustion engine-powered vehicle.

BACKGROUND ART

Evaporative emission control systems are widely used in internal combustion engine-powered motor vehicles to prevent evaporative fuel, i.e., fuel vapor, from being emitted from the fuel tank into the atmosphere. There are generally three main components that control such evaporative emission operations: vapor control/rollover valves, vapor management valves and fuel carbon canister(s). One or more of the above components may typically be found in an internal combustion engine-powered motor vehicle to control evaporative emission.

Evaporative emissions and engine driveability may be affected by the generation of fuel vapor in the evaporative system. Vapor generation can be inferred from a rise in fuel tank pressure. A detection of high vapor generation can be used to indicate that a leak does not exist in the evaporation system, and thus fuel vapors are not being released into the atmosphere.

Furthermore, a normal operating range of the vapor management valve is predetermined to provide a predetermined rate of flow. If a high amount of vapor is generated, the vapor management valve is forced to provide more flow than necessary. Thus, the operating range of the vapor management valve as well as the predetermined rate of flow is not optimum for the present engine conditions.

It is thus desirable to employ an on-board diagnostic system capable of determining a level of vapor generated by the evaporative system so that corrective measures may be taken. One known prior art method of monitoring the evaporative system is disclosed in U.S. Pat. No. 5,261,397, issued to Lipinski et al ("Lipinski"). Lipinski discloses a method of testing the mechanical integrity of an evaporative purge system by applying a vacuum to a fuel tank and measuring the extent to which this vacuum bleeds down over a time period. Lipinski requires the adaptive fuel control to be disabled while the test is performed. Lipinski fails to disclose an effective method and system for modifying the execution of the evaporative purge system monitor based on excessive pressure. Lipinski also fails to disclose a method and system for enhancing evaporative purge control based on the presence of excessive pressure.

DISCLOSURE OF THE INVENTION

It is thus a general object of the present invention to overcome the limitations of the prior art by providing a method and system for determining a level of vapor generated by an evaporative system.

In carrying out the above object and other objects, features and advantages of the present invention, a method is provided for determining the level of vapor generated by an evaporative system. The method includes the step of closing the evaporative system to atmosphere. The method also includes the step of sensing an initial pressure in the fuel tank and generating a corresponding signal and, after a predetermined amount of time, sensing a second pressure in the fuel tank and generating a corresponding signal. The method further includes the step of determining a pressure difference based on the sensed initial pressure and the sensed second pressure. Finally, the method includes the step of determining a level of vapor generated by the evaporative system based on the pressure difference.

Further, a system is also provided for carrying out the steps of the above described method. The system includes means for closing the evaporative system from atmosphere. The system also includes a sensor for sensing an initial pressure in the fuel tank and generating a corresponding signal and for sensing a second pressure in the fuel tank after a predetermined amount of time and generating a corresponding signal. Still further, the system includes means for determining a pressure difference based on the sensed initial pressure and the sensed second pressure and means for determining a level of vapor generated by the evaporative system based on the pressure difference.

The above objects and other objects, features and advantages of the present invention are readily apparent from the following detailed description of the best mode for carrying out the invention when taken in connection with the accompanying drawings.

BRIEF DESCRIPTION OF THE DRAWINGS

FIGS. 3*a*–3*d* is a flow diagram illustrating in more detail the general sequence of operation of the method of the present invention.

BEST MODES FOR CARRYING OUT THE INVENTION

Figure 1:
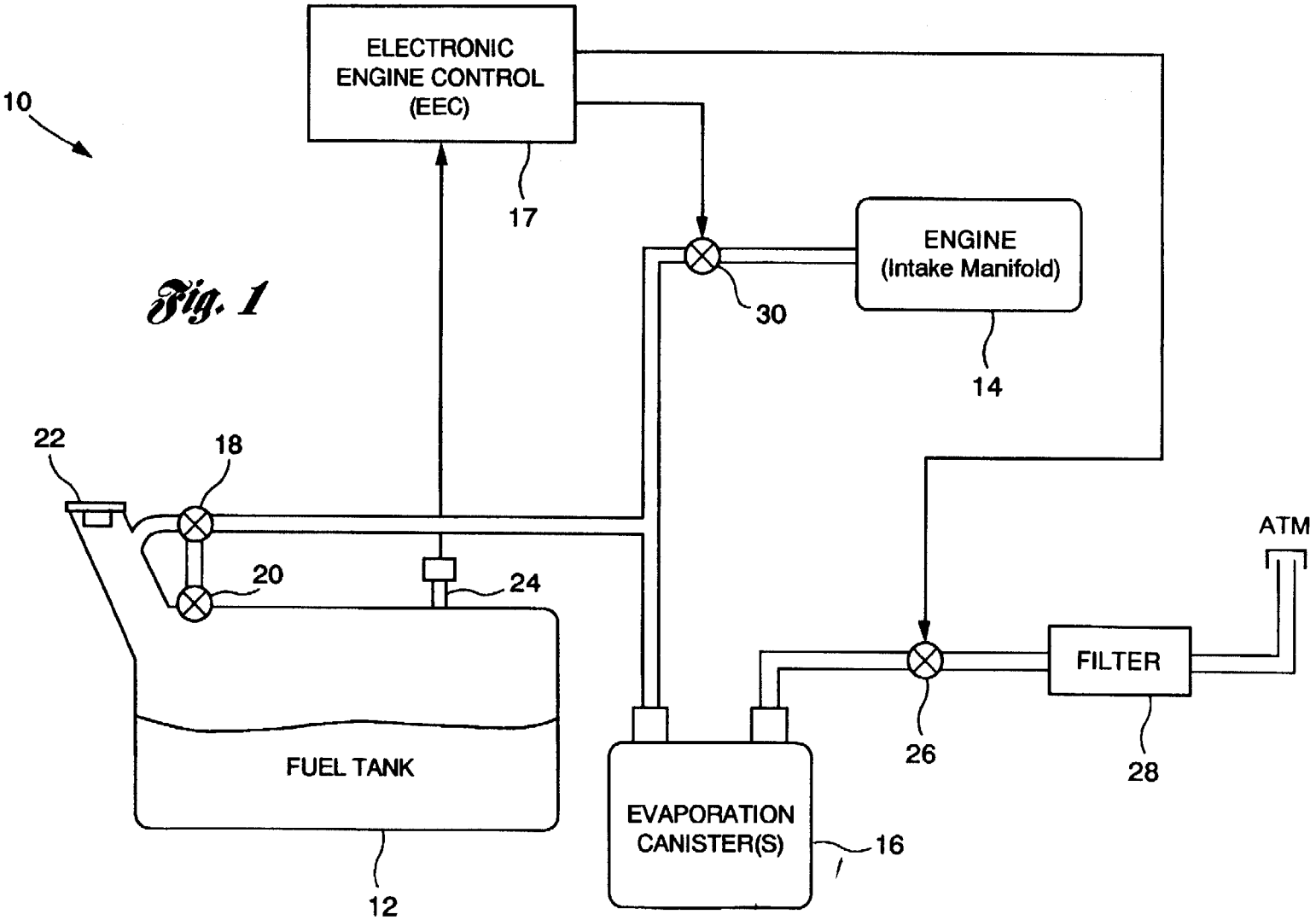
FIG. 1 is a schematic diagram of the preferred embodiment of the system of the present invention.

With reference to FIG. 1 of the drawings, there is provided a schematic diagram of the system of the present invention, designated generally by reference numeral 10. As shown, the system 10 includes a fuel tank 12, an internal combustion engine 14 and an evaporation canister 16 all in fluid communication, and an Electronic Engine Control (EEC) 17.

The fuel tank 12 provides fuel to the internal combustion engine 14 and typically includes a running loss vapor control valve 18 and a rollover valve 20. The fuel tank 12 may also include a vacuum and pressure relief valve 22, integral with the fuel tank cap, for preventing excessive vacuum or pressure from being applied to the fuel tank 12. The fuel tank 12 further includes a pressure transducer 24 for monitoring fuel tank pressure or vacuum and for providing an input to the EEC 17. The pressure transducer 24 may be installed directly into the fuel tank 12 (as shown in FIG. 1) or remotely mounted and connected by a line (not shown) to the fuel tank 12.

The evaporation canister 16 is provided for trapping and subsequently using fuel vapor dispelled from the fuel tank 12. The evaporation canister 16 is connected to atmosphere through a Canister Vent Valve (CVV) 26. A filter 28 may be provided between the CVV 26 and atmosphere for filtering the air pulled into the evaporation canister 16. The CVV 26 comprises a normally open solenoid controlled by the EEC 17 via an electrical connection to the CVV 26.

A Vapor Management Valve (VMV) 30 is interposed between the intake manifold (not shown) of the engine 14 and the fuel tank 12 and the evaporation canister 16. The VMV 30 comprises a normally closed solenoid which is also energized by the EEC 17. When the VMV 30 opens, the vacuum of the intake manifold of the engine 14 draws fuel vapors from the evaporation canister 16 for combustion in the cylinders (not shown) of the engine 14. When the EEC 17 de-energizes the VMV 30, fuel vapors are stored in the evaporation canister 16.

Figure 2:
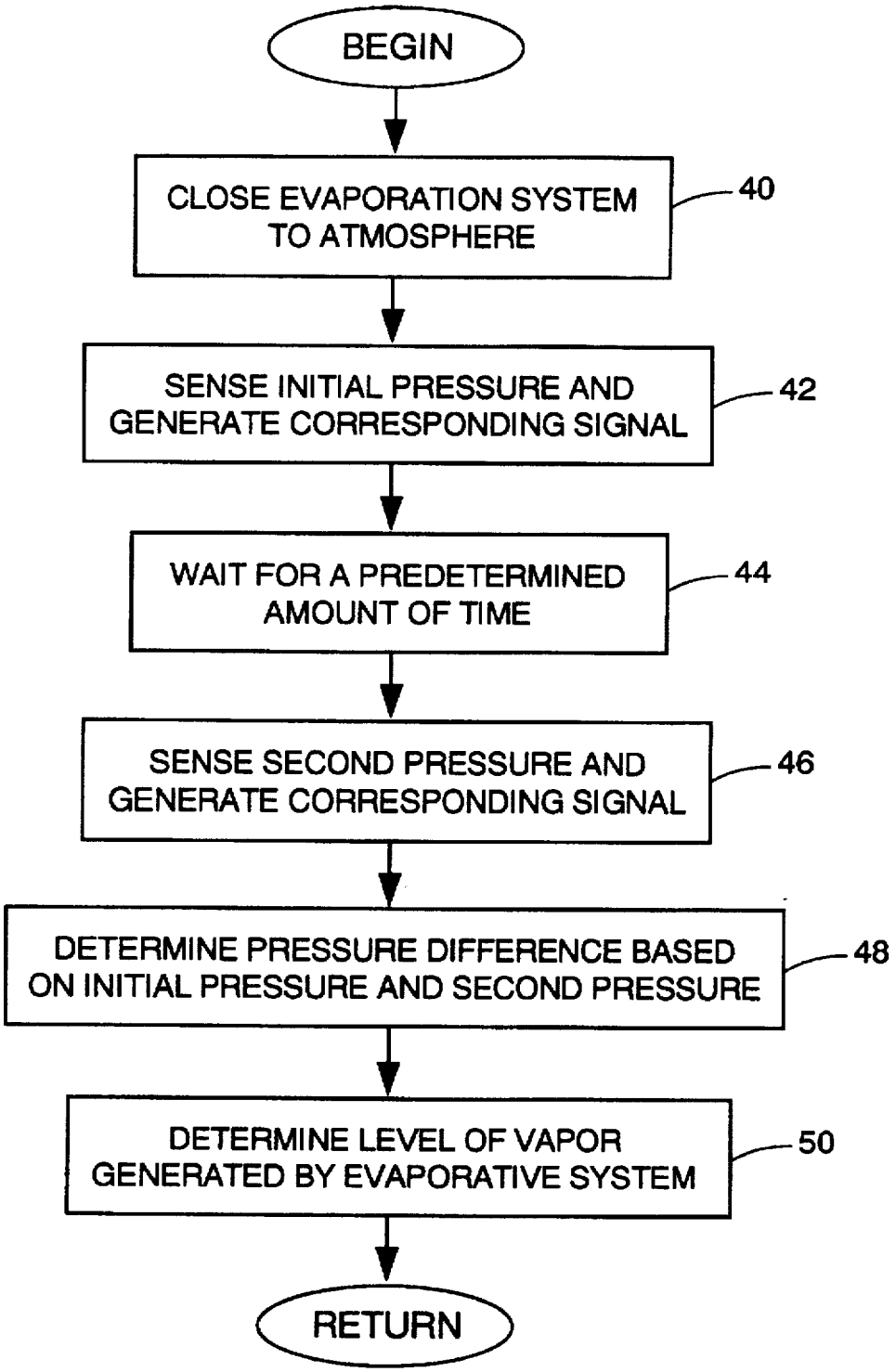
FIG. 2 is a flow diagram illustrating the general sequence of operation of the method of the present invention.
Figure 3A:
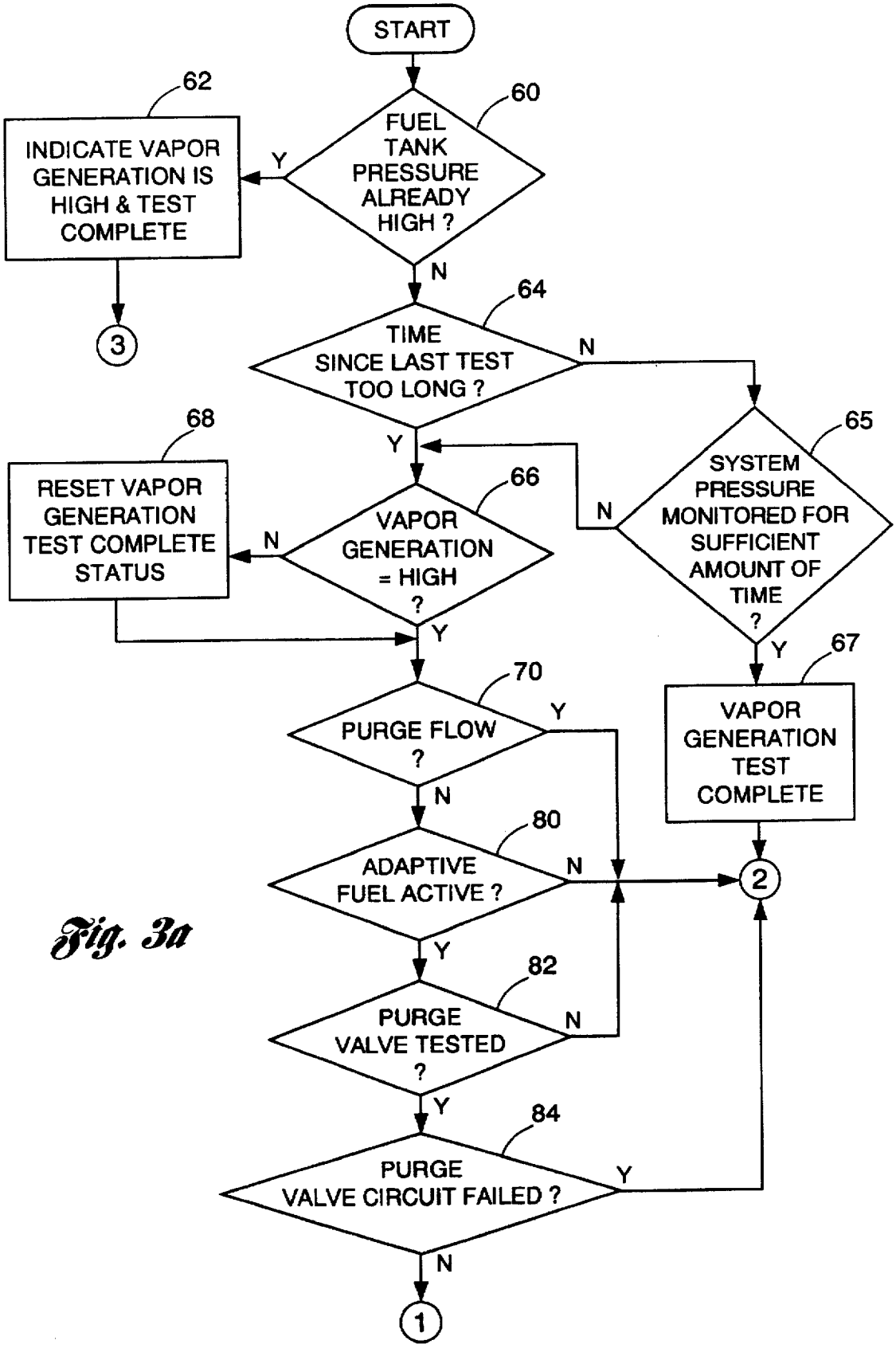
Figure 3B:
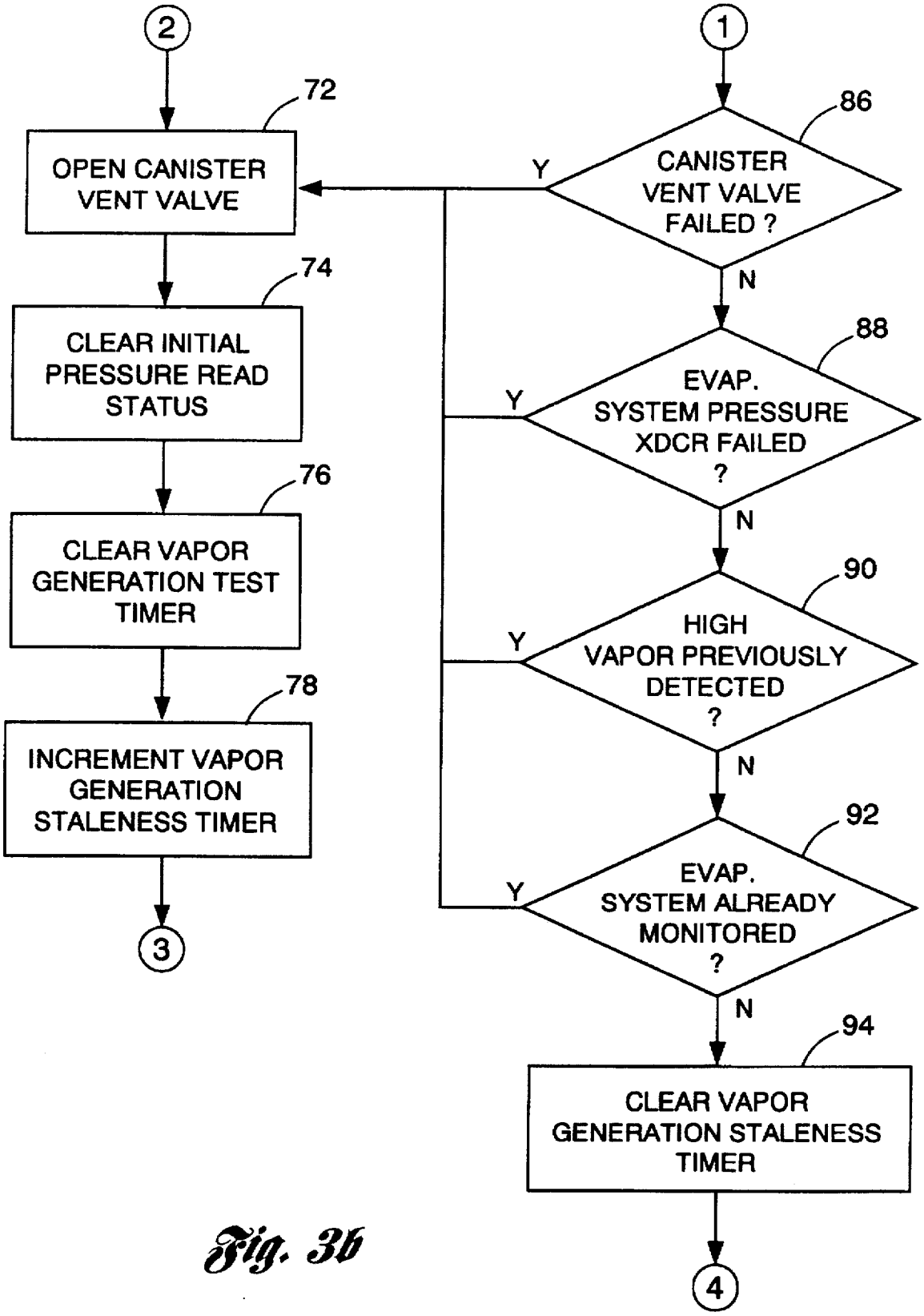
Figure 3B:
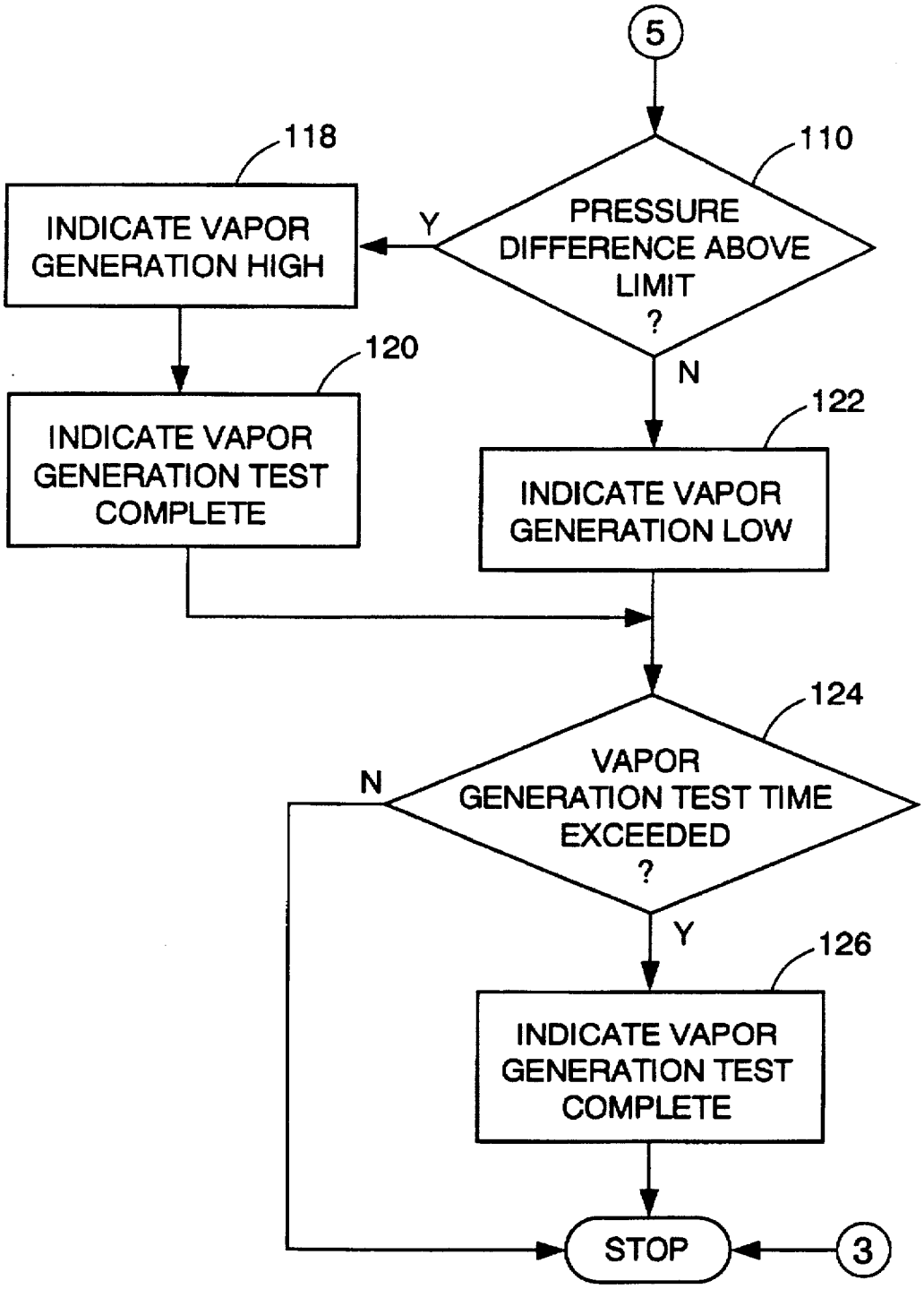

With reference now to the flow diagram of FIG. 2, the method steps of the present invention will now be described. The method begins with the step of closing the evaporative system to atmosphere, as shown at block 40. Next, an initial pressure in the fuel tank is sensed and a corresponding signal is generated, as shown at block 42.

The method proceeds to wait a predetermined amount of time, as shown at block 44. After waiting the predetermined amount of time, a second pressure is sensed and a corresponding signal is generated, as shown at block 46. A pressure difference is determined based on the sensed initial pressure and the sensed second pressure, as shown at block 48.

Finally, the method concludes with the step of determining a level of vapor generated by the evaporative system, as shown at block 50. If the fuel tank pressure increase does not achieve an expected pressure limit, a low level of vapor generation can be inferred and the evaporative system can be monitored for leaks and failures. However, if the fuel tank pressure increases in excess of the pressure limit when the evaporative system is closed to atmosphere high vapor generation can be inferred, and it can be assumed that the evaporative system is free of leaks. Thus, an abbreviated test for monitoring the evaporative system may be performed to verify the VMV 30 (purge valve) is functioning properly.

The evaporative system can be examined for leaks and failures in accordance with one of several methods known for monitoring an evaporative system. One known method is disclosed in U.S. patent application, Ser. No. 08/515,844, entitled "Method and System for Monitoring an Evaporative Purge System", filed Aug. 16, 1995. For example, if the pressure increase is less than the pressure limit, the entire test, Phase 0–5, would be executed. However, if the pressure increase is above the pressure limit only Phase 0, the vacuum application phase, would be necessary to execute in order to determine if the VMV 30 is functioning properly. If a target vacuum is reached, the evaporative system would pass the VMV flow test in addition to the leak test.

A determination of a high level of vapor generated by the evaporative system can also be used to adjust the operating range of the VMV 30 to compensate for the excessive pressure. For example, the VMV 30 may be calibrated to have an operating range of 30%–100% and flow rate expressed as an opening of the VMV 30 at the rate of 1% duty cycle/second for a given air mass. However, if excessive pressure is present, the VMV 30 may be forced to open sooner than required. Therefore, the VMV 30 must be commanded to deliver vapor more slowly via a lower opening duty cycle and a slower ramp rate in order to maintain a desired engine performance. It may be desirable then to adjust the operating range to approximately 10%–100% and reducing the VMV 30 opening rate to approximately 0.5%/second for a given air mass in order to prevent the VMV 30 from purging too quickly. The driveability and the emissions of the vehicle are thus improved.

Turning now to FIGS. 3a–3d, there is shown a flow diagram illustrating in more detail the general sequence of operation of the method of the present invention. The method begins with a Pressure Bypass Logic stage. First, the fuel tank pressure is compared to a high vapor limit, typically 2"$H_2O$, as shown at conditional block 60. If the fuel tank pressure is already high, a vapor generation flag is set to high and the test is complete, as shown at block 62. If not, the method proceeds to a Vapor Generation Staleness Logic stage. A check is made to determine whether the time since the last test is too long via a staleness timer, as shown at conditional block 64. The staleness timer is typically calibrated in the range of 1200–2000 seconds to ensure the results from the method more accurately represent current vehicle conditions.

If the data is stale, a check is made as to whether or not the vapor generation flag is set to high, as shown at conditional block 66. If the vapor generation flag is not set to high, the vapor generation test complete status flag is reset, as shown at block 68.

If the data is not stale, the method proceeds to determine if the system pressure has been monitored for a sufficient amount of time, as shown at block 65. If the system pressure has been monitored for a sufficient amount of time, e.g., 2 minutes, then the vapor generation test is complete, as shown at block 67. If the system pressure has not been monitored for a sufficient amount of time, the method continues to determine if the vapor generation flag has been set to high, as described above.

Next, the method proceeds to determine whether a plurality of entry conditions have been met. First, a check is made as to whether purge flow is active, as shown at conditional block 70.

If purge flow is active, the CVV 26 is opened, as shown at block 72. The method proceeds to clear an initial pressure read status flag, as shown at block 74. The vapor generation test timer is also cleared, as shown at block 76. Finally, the vapor generation staleness timer is incremented, as shown at block 78. Since purge flow is active, the entry conditions are not met and the test is aborted.

If purge flow is not active, the method proceeds to determine whether the adaptive fuel is active, as shown at conditional block 80. Adaptive fuel control is activated to compensate for abnormalities in fuel delivery, such as a leaky fuel injector. If adaptive fuel control is not active, the CVV 26 is opened, as shown at block 72, and the method steps indicated at blocks 74, 76 and 78, respectively, are executed.

If adaptive fuel is active, the method proceeds to determine if the purge valve, or VMV 30, has been tested for electrical failures, as shown at conditional block 82. If the VMV 30 has not been tested, the CVV 26 is opened, as shown at block 72, and the method steps indicated at blocks 74, 76 and 78, respectively, are executed.

If the VMV 30 has been tested, the method proceeds to determine if the VMV 30 circuit has failed, as shown at conditional block 84. If the VMV 30 circuit has failed, the CVV 26 is opened, as shown at block 72, and the method steps indicated at blocks 74, 76 and 78, respectively, are executed.

If the VMV 30 circuit has not failed, a check is made to determine if the CVV 26 has failed, as shown at conditional block 86. If so, the CVV 26 is opened, as shown at block 72, and the method steps indicated at blocks 74, 76 and 78, respectively, are executed. If the CVV 26 has not failed, the method proceeds to determine if the evaporative system pressure transducer 24 (XDCR) has failed, as shown at conditional block 88. If the pressure transducer 24 has failed, the method proceeds to open the CVV 26, as shown at block 72, and execute the steps indicated at blocks 74, 76 and 78, respectively.

If the pressure transducer 24 has not failed, a check is made as to whether high vapor has been previously detected, as shown at conditional block 90. If so, the CVV 26 is opened, as shown at block 72, and the steps indicated at blocks 74, 76 and 78, respectively, are executed. If high vapor has not been previously detected, the method proceeds to determine if the evaporative system integrity has already been monitored for leaks, as shown at conditional block 92.

If the evaporative system has been monitored, the CVV 26 is opened, as shown at block 72, and the method steps indicated at blocks 74, 76 and 78, respectively, are executed. If the evaporative system has not been monitored, the vapor generation staleness timer is cleared, as shown at block 94.

The method proceeds to a Vapor Generation Test stage where the pressure is first compared to a set point, as shown at conditional block 96. The set point is used to determine if the system has any prevailing vacuum in the fuel tank which would tend to indicate the VMV 30 is open. The set point is, preferably, set to ambient pressure, or zero. If the pressure is above the set point, the CVV 26 is closed as shown by block 98, and the method proceeds to determine whether an initial pressure has been read, as will be described below.

If the pressure is not above the set point, the pressure is compared to a clear point, as shown at conditional block 100. The clear point provides a hysteresis to keep the test running and is, typically, $-1"H_2O$. If the pressure is below the clear point, the CVV 26 is opened, as shown at block 102. After opening or closing the CVV 26, a check is made as to whether an initial pressure reading has taken place, as shown at conditional block 104.

If an initial pressure reading has occurred, the method checks to determine if the CVV 26 is closed, as shown at conditional block 106. If the CVV 26 is closed, a pressure difference is determined based on an initial pressure reading and the current pressure reading, as shown at block 108. The pressure difference is then compared to a predetermined pressure limit, as shown at conditional block 110. The predetermined pressure limit represents an increase in pressure that is indicative of high pressure and is, typically, $2"H_2O$. If the CVV 26 is not closed, the pressure difference is compared to the predetermined pressure limit, as shown at conditional block 110.

Returning to block 104, if the initial pressure reading has not taken place, a check is made as to whether the CVV 26 is closed, as shown at conditional block 112. If the CVV 26 is not closed, the test is aborted. If the CVV 26 is closed, an initial pressure reading flag is set and an initial fuel tank pressure is read, as shown by blocks 114 and 116, respectively. After reading the initial fuel tank pressure, the pressure difference is determined based on the initial pressure reading and the current pressure reading, as shown at block 108. Since the current pressure reading equals the initial pressure reading at this time, the pressure difference will be zero. However, the current pressure reading will subsequently grow as the test continues and vapor is being generated. The pressure difference is then compared to the pressure limit, as shown at conditional block 110.

If the pressure difference is above the predetermined pressure limit, high vapor generation is indicated, as shown by block 118, and the evaporative purge system may be monitored for proper purge flow as described above. The vapor generation test is then indicated as being complete, as shown at block 120. If the pressure difference is below the predetermined pressure limit, a low level of vapor generation is indicated, as shown at block 122, and the evaporative purge system may be monitored for leaks and failures as described above.

Finally, the method proceeds to determine whether the vapor generation test time has been exceeded, as shown at conditional block 124. If not, the test is complete and repeated on the following test cycle. If the test time has been exceeded, a vapor generation test complete indication is made, as shown at block 126.

While the best modes for carrying out the invention have been described in detail, those familiar with the art to which this invention relates will recognize various alternative designs and embodiments for practicing the invention as defined by the following claims.

What is claimed is:

1. For use with an evaporative system including a fluid filled tank and a vapor management valve in fluid communication with the tank, the vapor management valve having an operating range and a ramp rate, a method for controlling a flow of vapor in the evaporative system, the method comprising:

(a) closing the evaporative system to atmosphere;

(b) sensing an initial pressure in the tank and generating a corresponding signal;

(c) after a predetermined amount of time, sensing a second pressure in the tank and generating a corresponding signal;

(d) determining a pressure difference based on the sensed initial pressure and the sensed second pressure;

(e) determining a level of vapor generated by the evaporative system based on the pressure difference; and (f) controlling the operating range and the ramp rate of the vapor management valve based on the level of vapor generated by the evaporative system so as to control the flow of vapor.

2. The method as recited in claim 1 wherein the step of determining the level of vapor generated includes the step of comparing the pressure difference to a predetermined pressure limit.

3. The method as recited in claim 2 wherein the step of determining the level of vapor generated further includes the step of determining a high level of vapor generated by the evaporative system if the pressure difference exceeds the predetermined pressure limit.

4. The method as recited in claim 3 wherein the method further comprising the step of determining whether the vapor management valve is functioning.

5. The method as recited in claim 2 wherein the step of determining the level of vapor generated further includes the step of determining a low level of vapor generated by the evaporative system if the pressure difference is less than the predetermined pressure limit.

6. The method as recited in claim 5 further comprising the step of determining whether leaks are present in the evaporative system.

7. The method as recited in claim 1 further comprising the step of determining whether a plurality of test conditions have been met prior to step (a).

8. The method as recited in claim 3 wherein the step of controlling further includes the step of reducing the ramp rate of the vapor management valve.

9. For use with an evaporative system including a fluid-filled tank and a vapor management valve in fluid communication with the tank, the vapor management valve having an operating range and a ramp rate, a system for controlling a flow of vapor in the evaporative system, the system comprising:

means for closing the evaporative system to atmosphere;

a sensor sensing an initial pressure in the tank and a second pressure in the tank and generating corresponding signals;

means for determining a pressure difference based on the sensed initial pressure and the sensed second pressure;

means for determining a level of vapor generated by the evaporative system based on the pressure difference; and means for controlling the operating range and the ramp rate of the vapor management valve based on the level of vapor generated by the evaporative system so as to control the flow of vapor.

10. The system as recited in claim 9 wherein the means for determining the level of vapor generated includes means for comparing the pressure difference to a predetermined pressure limit.

11. The system as recited in claim 10 wherein the means for determining the level of vapor generated further includes means for determining a high level of vapor generated by the evaporative system if the pressure difference exceeds the predetermined pressure limit.

12. The system as recited in claim 11 wherein the system further comprising means for determining whether the vapor management valve is functioning.

13. The system as recited in claim 10 wherein the means for determining the level of vapor generated further includes means for determining a low amount of vapor generated by the evaporative system if the pressure difference is less than the predetermined pressure limit.

14. The system as recited in claim 13 further comprising means for determining whether leaks are present in the evaporative system.

15. The system as recited in claim 9 further comprising means for determining whether a plurality of test conditions have been met prior to step (a).

16. The system as recited in claim 9 wherein the means for closing the evaporative system is a valve.

17. The system as recited in claim 11 further comprising means for reducing the ramp rate of the vapor management valve.

18. The system as recited in claim 9 wherein the evaporative system is an evaporative system of an automotive vehicle.

19. The method as recited in claim 3 wherein the step of controlling the operating range includes reducing the operating range of the vapor management valve.

20. The system as recited in claim 11 wherein the means for controlling the operating range includes means for reducing the operating range of the vapor management valve.

* * * * *